US009835168B2

(12) United States Patent
Uchida et al.

(10) Patent No.: US 9,835,168 B2
(45) Date of Patent: Dec. 5, 2017

(54) CASING LINER FOR SEWAGE PUMP AND SEWAGE PUMP WITH THE SAME

(71) Applicant: EBARA CORPORATION, Tokyo (JP)

(72) Inventors: Hiroshi Uchida, Tokyo (JP); Masahito Kawai, Tokyo (JP); Hiromi Sakacho, Tokyo (JP); Masashi Obuchi, Tokyo (JP); Miho Isono, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 307 days.

(21) Appl. No.: 14/724,096

(22) Filed: May 28, 2015

(65) Prior Publication Data

US 2015/0345505 A1 Dec. 3, 2015

(30) Foreign Application Priority Data

May 30, 2014 (JP) ..... 2014-112800

(51) Int. Cl.

| | |
|---|---|
| ***E03F 5/22*** | (2006.01) |
| ***E03F 5/26*** | (2006.01) |
| ***F04D 7/04*** | (2006.01) |
| ***F04D 13/02*** | (2006.01) |
| ***F04D 29/043*** | (2006.01) |

(Continued)

(52) U.S. Cl.

CPC ..... *F04D 29/4286* (2013.01); *E03F 5/22* (2013.01); *E03F 5/26* (2013.01); *F04D 7/04* (2013.01); *F04D 7/045* (2013.01); *F04D 13/02* (2013.01); *F04D 29/043* (2013.01); *F04D 29/22* (2013.01); *E03F 2201/00* (2013.01); *F04D 29/2288* (2013.01)

(58) Field of Classification Search

CPC . F04D 7/04; F04D 13/02; F04D 29/22; F04D 29/4286; F04D 29/2288; F04D 7/045; E03F 5/26; E03F 5/22; E03F 2201/00

See application file for complete search history.

(56) References Cited

U.S. PATENT DOCUMENTS

| | | | | |
|---|---|---|---|---|
| 1,820,150 A | | 8/1931 | Moody | |
| 4,349,322 A | * | 9/1982 | Stahle | F04D 29/586 415/112 |

(Continued)

FOREIGN PATENT DOCUMENTS

| | | |
|---|---|---|
| JP | S49-108103 U | 1/1973 |
| JP | S64-11390 U | 1/1989 |

(Continued)

OTHER PUBLICATIONS

Supplemental European Search Report for Application No. 15169749.7-1607, dated Oct. 15, 2015.

*Primary Examiner* — Igor Kershteyn

(74) *Attorney, Agent, or Firm* — Pearne & Gordon LLP

(57) ABSTRACT

A casing liner used for a sewage pump includes a surface to face an edge of a blade of an impeller when the casing liner is assembled with the impeller into the sewage pump. At least one groove with given width is formed in at least a part of the surface. The groove includes a first section with given depth, which is located on the side close to a rotational center of the impeller, a second section smaller in depth than the first section, which is located on the side far from the rotational center of the impeller, and a third section that is an inclined face connecting the first and second sections, the first to third sections being arranged in a width direction of the groove.

10 Claims, 5 Drawing Sheets

(51) Int. Cl.
*F04D 29/22* (2006.01)
*F04D 29/42* (2006.01)

(56) References Cited

U.S. PATENT DOCUMENTS

| | | | | |
|---|---|---|---|---|
| 6,139,260 | A | 10/2000 | Arbeus | |
| 6,190,121 | B1 | 2/2001 | Hayward et al. | |
| 8,109,730 | B2 * | 2/2012 | Andersson | F04D 7/045 415/121.1 |
| 8,231,337 | B2 * | 7/2012 | Andersson | F04D 7/045 415/121.1 |
| 8,979,476 | B2 * | 3/2015 | Davis | F04D 29/167 415/121.1 |
| 2009/0208336 | A1 | 8/2009 | Lindskog | |
| 2015/0292519 | A1 | 10/2015 | Stark et al. | |

FOREIGN PATENT DOCUMENTS

| | | | |
|---|---|---|---|
| JP | H11-201087 | A | 7/1999 |
| WO | 2014-086472 | A1 | 6/2014 |

* cited by examiner

CASING LINER FOR SEWAGE PUMP AND SEWAGE PUMP WITH THE SAME

TECHNICAL FIELD

The present invention relates to a sewage pump, and more specifically, to a sewage pump used mainly for pumping sewage containing long fibrous refuse (foreign objects), such as pieces of rope or string, and volumes of large solids, and also relates to a casing liner used for the sewage pump.

BACKGROUND ART

In general, sewage may contain long fibrous refuse, volumes of large solids and the like. In a sewage pump for pumping such sewage, the refuse sometimes gets tangled in a suction end of an impeller or stuck between a blade of the impeller and a casing liner. The refuse gradually increases over time and clogs a channel in the impeller. The clogging often decreases the flow rate of the sewage transferred by the sewage pump.

This can be considered attributable to urbanization of recent years. Namely, the development of urbanization discourages the construction of sewage treatment plants in residential areas, but instead contributes the construction of intermediary pump stations in residential areas, which transfer water to suburban sewage treatment plants. To avoid the environmental pollution associated with bad smell coming from refuse and refuse transport, these pump stations barely remove a number of different waste materials mixed into sewage and transfer the sewage and the refuse together to the sewage treatment plants. This incurs clogging troubles in sewage pumps as mentioned above.

Sewage pumps for pumping sewage containing foreign objects, such as long fibrous refuse and volumes of large solids, drainage water containing garbage from kitchens, and the like, have been equipped with an open impeller or semi-open impeller to prevent the foreign objects from getting stuck in the impeller or the casing. However, the foreign objects still sometimes get stuck between the blade and the casing liner, hampering the pumping and incurring burnout in a drive motor or the like.

One proposed means for solving the above problems is a casing liner with radial grooves which is installed to face an impeller (FIGS. 2 and 3 of the Japanese Utility Model Public Disclosure No. S49-108103, and FIGS. 2 and 3 of the Japanese Utility Model Public Disclosure No. S64-11390). The means is to shred the fibrous foreign substances sucked in from the suction inlet of a sewage pump, by using the grooves of the casing liner and the impeller, and then discharge the foreign substances toward the outlet end of the pump. To be more specific, when foreign objects enter the radial grooves formed in the inner wall surface of the casing liner, blades shred the foreign objects as cutter blades in the position facing the casing liner to prevent the foreign objects from clogging in gaps. It is also suggested to form a groove that varies in depth in the surface of a pump housing, which faces the blade of a pump impeller (FIG. 4 of the Japanese Patent Public Disclosure No. H11-201087).

SUMMARY

However, the above-mentioned related art documents have the following problems. If long fibrous foreign objects or volumes of large foreign objects enter the channel of the impeller, the foreign objects that have been shredded are stuck in the groove and then cannot be smoothly discharged from the discharge port of the pump. Especially according to the Japanese Utility Model Public Disclosure Nos. S49-108103 and S64-11390, each groove has a symmetrical cross-sectional shape, which is not designed in consideration of the direction of sewage flow. The Japanese Patent Public Disclosure No. H11-201087 discloses a groove unsymmetrical in terms of depth. However, the depth continuously varies from the deepest to the shallowest portion. This makes foreign objects hard to be detached from the surface of the groove.

One embodiment provides a casing liner used for a sewage pump. The casing liner includes a surface to face an edge of a blade of an impeller when the casing liner is assembled with the impeller into the sewage pump. At least one groove with given width is formed in at least a part of the surface. The groove includes a first section with given depth, which is located on the side close to a rotational center of the impeller, a second section smaller in depth than the first section, which is located on the side far from the rotational center of the impeller, and a third section that is an inclined face connecting the first and second sections, the first to third sections being arranged in a width direction of the groove.

DESCRIPTION OF EMBODIMENTS

Figure 1A:
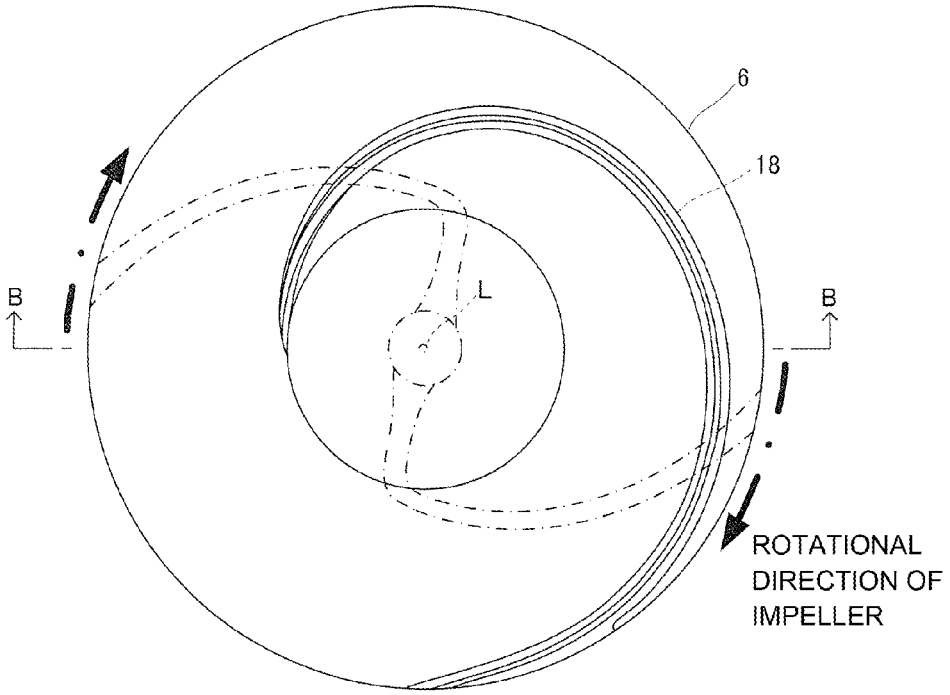
FIGS. 1A to 1C illustrate a casing liner according to one embodiment of the invention, FIG. 1 A being a plan view, FIG. 1B being a cross-sectional view along the line B-B in FIG. 1A, and FIG. 1C being an enlarged view of a portion encircled by a dotted circle in FIG. 1B.

A first embodiment provides a casing liner used for a sewage pump. The casing liner includes a surface to face an edge of a blade of an impeller when the casing liner is assembled with the impeller into the sewage pump. At least one groove with given width is formed in at least a part of the surface. The groove includes a first section with given depth, which is located on the side close to a rotational center of the impeller, a second section smaller in depth than the first section, which is located on the side far from the rotational center of the impeller, and a third section that is an inclined face connecting the first and second sections, the first to third sections being arranged in a width direction of the groove.

When the sewage pump thus configured is used to pump sewage, the sewage occasionally contains long fibrous refuse and volumes of large refuse. In such a case, the fibrous refuse sometimes gets tangled in a suction end of the impeller. The refuse which is about to get tangled in the suction end of the impeller is forced to move in a radially outward direction of the impeller by centrifugal force. When the refuse reaches the outermost circumference of the suction end of the impeller, sewage flow forces the refuse into a gap between the impeller and the casing liner. The refuse thus forced into the gap is shredded by the groove formed in the casing liner and the edge of the blade facing the casing liner. If the fibrous refuse or volumes of large refuse, which has been shredded, enters the groove, the refuse is detached from the groove due to water flow velocity and refuse transfer speed (acceleration rate) which are changed by the third section that is the inclined face connecting the first and second sections of the groove, and (due to the changed refuse transfer speed) the refuse can be smoothly removed from the groove.

According to a second embodiment, in addition to the first embodiment, the first and second sections are substantially parallel to an inner wall surface of the casing liner.

According to a third embodiment, in addition to the first or second embodiment, both ends of the groove are formed into walls substantially perpendicular to the surface of the casing liner.

According to a fourth embodiment, in addition to any one of the first to third embodiments, the groove is formed into a spiral extending from a portion which coincides with a suction end of the impeller toward a portion which coincides with an outlet end of the impeller.

According to a fifth embodiment, in addition to any one of the first to fourth embodiments, the groove is formed into a spiral extending in the same direction as a rotational direction of the impeller to approach an outer circumference of the casing liner.

According to a sixth embodiment, in addition to any one of the first to fifth embodiments, the groove is formed within an area where the edge of the blade faces the casing liner when the casing liner is assembled with the impeller into the sewage pump.

A seventh embodiment provides a sewage pump. The sewage pump includes the casing liner of any one of the first to sixth embodiments, an impeller facing the casing liner, a rotary shaft on which the impeller is mounted, and a motor configured to rotate the rotary shaft.

According to an eighth embodiment, in addition to the seventh embodiment, a suction end of a blade of the impeller extends from a rotational center side radially outward in an opposite direction to the rotational direction of the impeller.

According to a ninth embodiment, in addition to the seventh or eighth embodiment, the impeller is of a semi-open type. The above-described embodiments will be described below in further details based on specific examples thereof.

<General Outline>

Figure 1B:
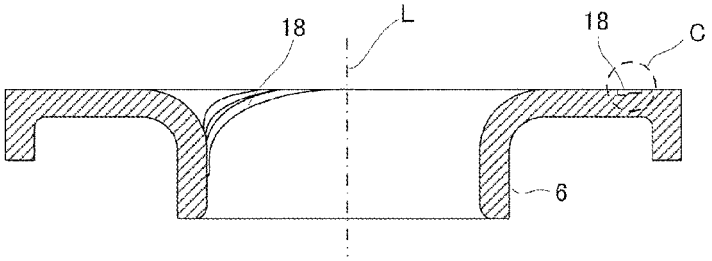
Figure 1C:
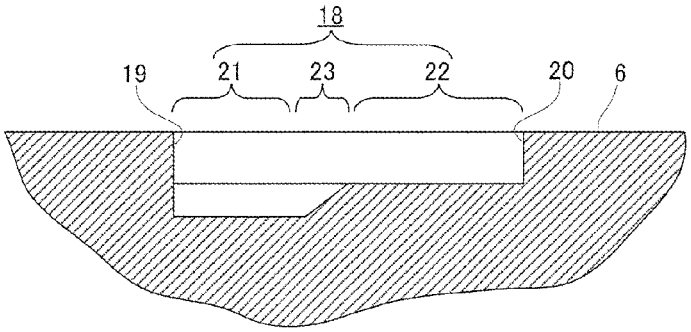
Figure 2:
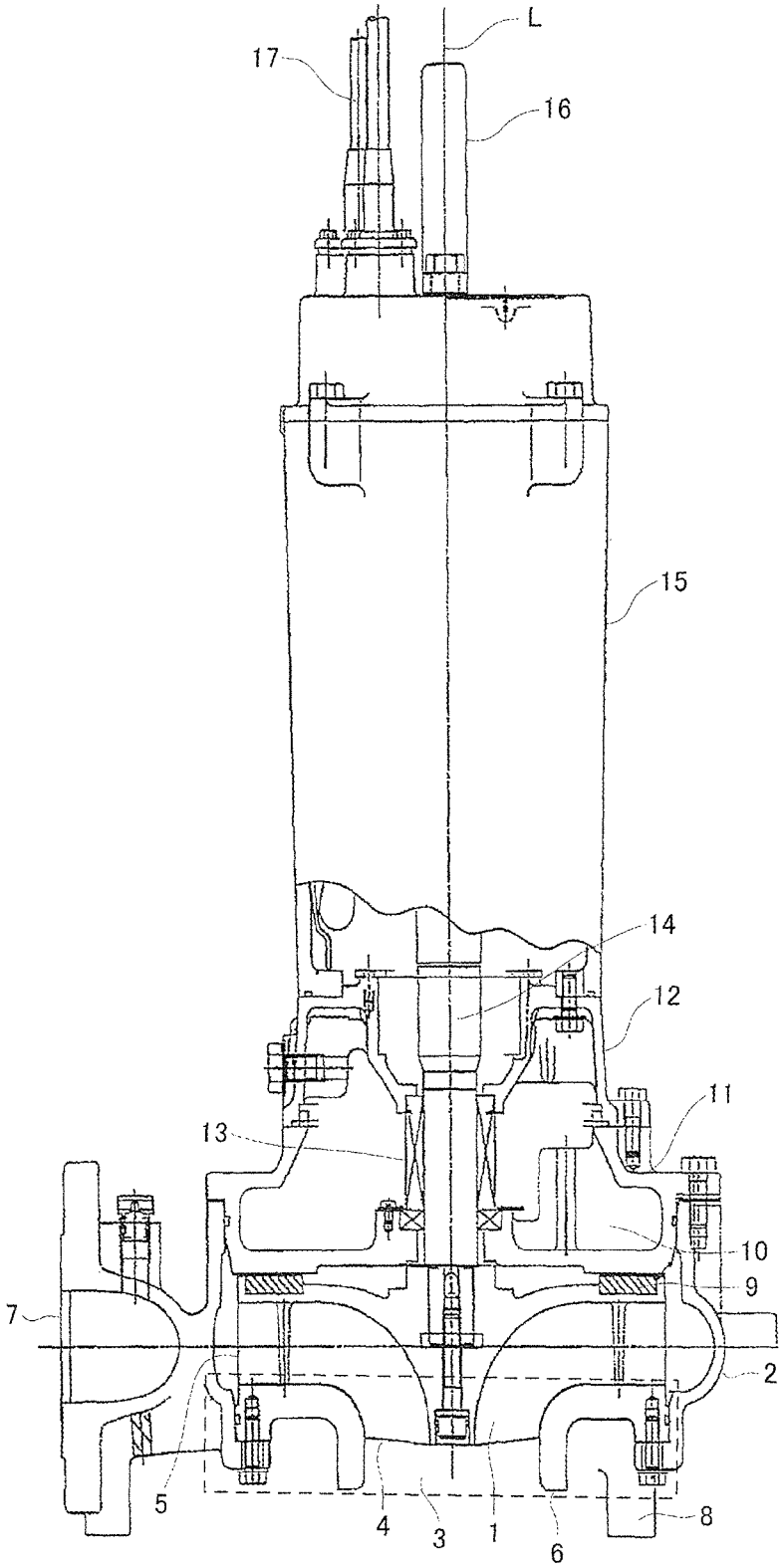
FIG. 2 is a partial cross-sectional view of a sewage pump with the casing liner disclosed in FIGS. 1A to 1C.

One embodiment of the invention will be described below with reference to the attached drawings. FIGS. 1A to 1C illustrate a casing liner 6 according to the present embodiment. FIG. 2 illustrates a vertical sewage pump equipped with the casing liner 6. As illustrated in FIG. 2, the sewage pump includes a pumping section in a lower part thereof and a motor 15 in an upper part thereof. A semi-open impeller 1 is mounted on the pumping section and fastened with a bolt to a lower end of a rotary shaft 14 extending from the motor 15. The impeller 1 is located in a space surrounded by a pump casing 2, the casing liner 6 and a pump casing cover 11.

A discharge port 7 is formed in the pump casing 2. The pump casing 2 is further provided with a pump casing foots 8 that are necessary for installation of the sewage pump. In the pump casing cover 11, a shaft seal mechanism 13 for sealing leakage water rising through a gap between the pump casing cover 11 and the rotary shaft 14 is located close to the motor 15. Disposed around the shaft seal mechanism 13 is a lubricant oil chamber 10 for containing lubricating oil for lubricating the shaft seal mechanism 13. A spacer 12 is disposed between the pump casing cover 11 and the motor 15, and supports the shaft seal mechanism 13 from above. The shaft seal mechanism 13 is further supported from below by the pump casing cover 11. In this manner, the shaft seal mechanism 13 is configured to be fastened by both the spacer 12 and the pump casing cover 11. A power cable 17 and a suspension device 16 are mounted on the top of the motor 15.

The impeller 1 includes one or more blades and is provided with a rib 9 for eliminating foreign objects mixed in high-pressure water that has flowed around the back of a main shroud. The rib 9 works when the impeller 1 is rotated. The blade of the impeller 1 includes an edge facing a surface of the casing liner 6. A suction port 3 opens in a lower part of the casing liner 6. The impeller 1 of the present embodiment includes two blades.

<Groove>

A spiral-shaped groove will be described below with reference to FIGS. 1A to 1C. The "spiral shape" here includes not only a two-dimensional spiral shape but also a three-dimensional spiral shape which is so-called a helical shape. In FIGS. 1A to 1C illustrating the casing liner 6, the impeller 1 rotates clockwise as shown by arrows in the drawings. A groove 18 is formed into a spiral shape. A start point of the spiral, which is close to the center, is located in an angular position corresponding to nine o'clock of the clock, and an end point in an outer circumference is located in an angular position corresponding to six o'clock. The groove is thus formed to extend over an angular range of approximately 270 degrees, stretching in the same direction as the rotational direction of the impeller (clockwise) to approach the outer circumference. The angular positions of the start and end points are given for the sake of explanation. The angular range of the groove is also not limited to 270 degrees, but may be set to an angular range of 90 or 360 degrees. The portion of the casing liner 6, which functions as the suction port 3, has a three-dimensional spiral shape. The groove 18 formed in an inner wall surface (upper face) of the casing liner 6 has a two-dimensional spiral shape.

As illustrated in FIG. 1B, the start point of the groove 18 formed in the inside of the suction port 3 is located in a generally middle portion as viewed in a height direction of the suction port 3. This is because, as illustrated in FIG. 2, an outermost circumference of the suction end 4 of the impeller 1 is located in the middle portion of the suction port 3. The groove 18 is thus formed in a position facing the edge of the blade of the impeller 1. As is apparent from FIGS. 1A and 1B, the spiral shape of the groove 18 extends from the angular position corresponding to nine o'clock to an angular position corresponding to twelve o'clock in an upward direction toward the motor 15. A portion stretching from the angular position corresponding to twelve o'clock to the angular position corresponding to six o'clock has a spiral shape. The outermost circumference of the casing liner 6 which is the end point of the groove 18 coincides with the position of an outlet end of the impeller.

A cross-sectional shape of the groove 18 will be described below with reference to FIG. 1C. FIG. 1C is an enlarged view of the portion encircled by a dotted circle C in FIG. 1B. Both ends of the groove 18 are formed into vertical faces 19 and 20 generally perpendicular to the inner wall surface (upper face) of the casing liner 6. A bottom face of the groove 18 is substantially parallel to the inner wall surface of the casing liner 6. However, the depth of the bottom face is different in right and left sides of the groove 18 as viewed in a width direction of the groove 18. In other words, the depth on the side where foreign objects enter is larger than that on the side where foreign objects leave.

Definitions will be given below for the wordings, "the side where foreign objects enter" and "the side where foreign objects leave". With reference to FIG. 1C, the left side of the groove 18 is closer to a rotational center L of the impeller, and the right side of the groove 18 is closer to the outer circumference of the impeller. The sewage pump of the present embodiment is of a centrifugal type, so that the foreign objects move from left to right. As viewed in FIG. 1C, therefore, it is defined that the left side of the groove 18 is the side where foreign objects enter and that the right side of the groove 18 is the side where foreign objects leave. The groove 18 of the present embodiment includes a first section 21 located on the side where the foreign objects enter, which is large in depth, and a second section 22 located on the side where the foreign objects leave, which is smaller in depth than the first section 21. The first and second sections 21 and 22 are connected via a third section 23 which is inclined at a given angle. The inclination angle of the third section 23 ranges from 30 to 60 degrees, inclusive, as an example. The inclined face functions to bias the shredded foreign objects to discharge the foreign objects from the groove 18. Details will be later explained.

<Operation>

Figure 3A:
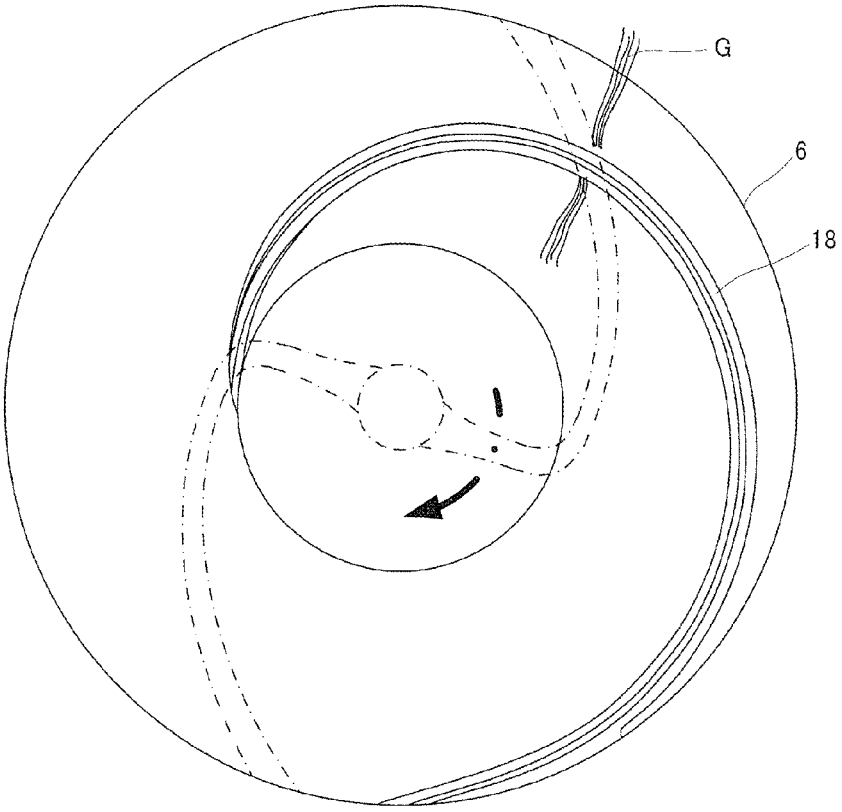
FIGS. 3A and 3B illustrate the casing liner disclosed in FIG. 1A, FIG. 3A being a view of the casing liner with which an impeller is virtually combined, and FIG. 3B being a lateral view of the casing liner.
Figure 3B:
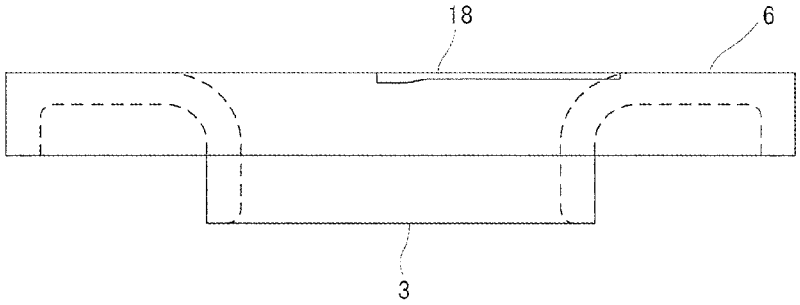

Operation of the casing liner 6 and the groove 18 formed therein according to the present embodiment will be described with reference to FIGS. 2, 3A and 3B. As a drive force of the motor 15 rotates the impeller 1, sewage is sucked in from the suction port 3. The sewage occasionally contains long fibrous refuse and the like. The fibrous refuse sometimes gets tangled in the suction end 4 of the impeller 1. As illustrated in FIGS. 3A and 3B, the suction end 4 of the impeller 1 of the present embodiment is curved in an opposite direction to the rotational direction of the impeller 1 as stretching from the rotational center L side to approach the outer circumference. For that reason, if the fibrous refuse gets tangled in the suction end 4 of the impeller 1, the refuse is forced toward the outer circumference side in the suction end 4 due to a centrifugal force and a force applied by a sewage flow.

After passing the outermost circumference of the suction end 4, the fibrous refuse enters between the edge of the blade and the casing liner 6 due to the sewage flow. If the fibrous refuse exists at intersection of the edge of the blade and the groove 18, the vertical faces 19 and 20 of the groove 18 and the edge of the blade operate to shred fibrous refuse G as illustrated in FIGS. 3A and 3B. This operation reliably prevents the refuse from getting stuck between the impeller 1 and the casing liner 6. The present embodiment achieves this advantageous effect with respect to not only fibrous refuse but also volumes of large refuse. Both fibrous refuse and volumes of large refuse can be shredded into small pieces by the operation of the groove, and smoothly drained with sewage.

In addition to the operation described above, the present embodiment provides another special operation, which is achieved by a distinctive cross-sectional shape of the groove 18. As illustrated in FIG. 1C, the groove 18 includes the first section 21 that is large in depth and the second section 22 that is small in depth. The first and second sections 21 and 22 are connected via the third section 23 that is the inclined face. Since the first section 21 is located closer to the rotational center L of the impeller 1, sewage is directed from the first section 21 toward the second section 22. Once refuse enters the first section 21, the sewage flow transfers the refuse from left to right. The refuse is given a velocity component oriented toward the inner wall surface (upside in the drawing) of the casing liner 6 along the inclined face of the third section 23.

There is a great angular difference between the third section 23 and the second section 22, namely, an inclined plane and a horizontal plane, respectively. The refuse is therefore detached from the surface of the second section 22 because of the velocity component given to the refuse, which is oriented toward the inner wall surface of the casing liner 6. The refuse is then easily eliminated from the groove 18 and flows downward with the sewage. To put it another way, the groove 18 of the present embodiment is formed of a combination of the first and second sections 21 and 22 with the third section 23 interposed therebetween, the first and second sections 21 and 22 being substantially parallel to each other, and the third section 23 being inclined relative to the first and second sections 21 and 22. This combination inhibits the refuse from accumulating in the groove 18. Moreover, since the groove 18 is formed into a spiral which extends from the suction port 3 of the casing liner 6 to the outlet end, the refuse is pushed along the spiral-shaped groove 18 and discharged to the outlet end of the blade.

Figure 4:
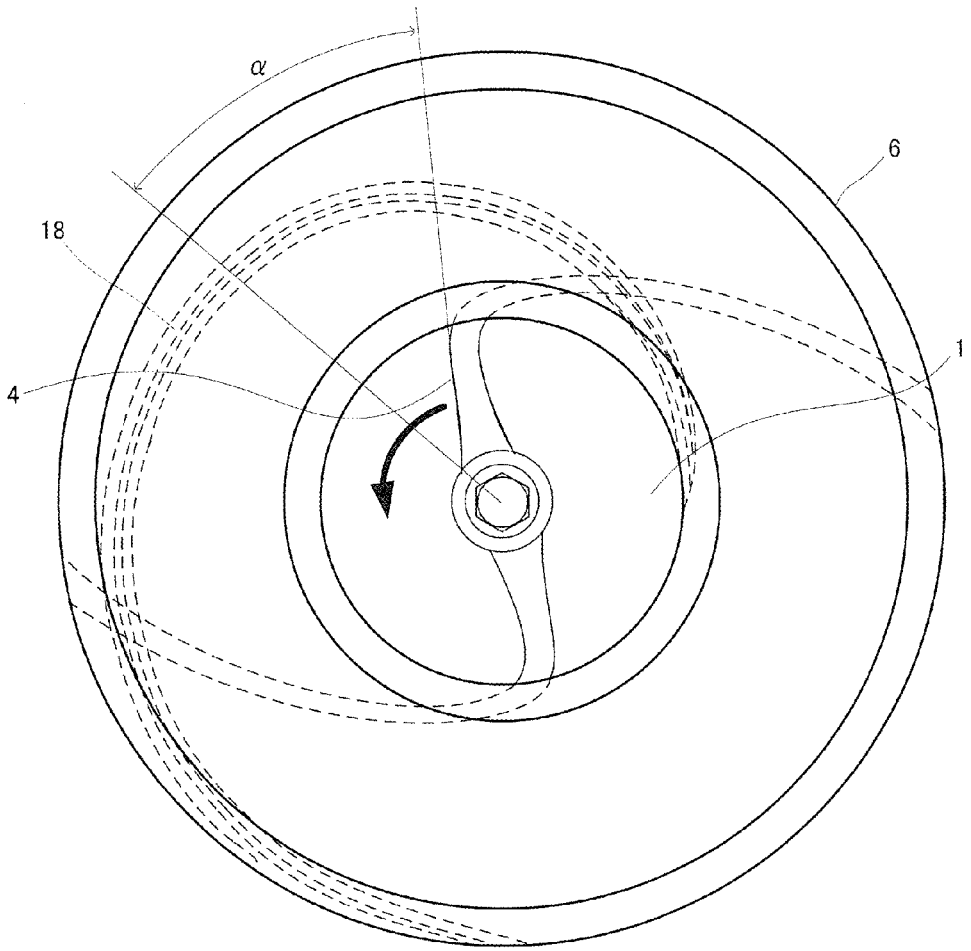
FIG. 4 illustrates the casing liner disclosed in FIGS. 1A to 1C, with which an impeller is combined, and is a bottom view that is viewed from a suction port.

As described above, the fibrous refuse and volumes of large refuse, which have been shredded by the groove 18 of the casing liner and the edge of the blade, are discharged toward the outlet end of the impeller 1 without being accumulated, due to the operation of the groove 18. FIG. 4 illustrates the casing liner 6 and the impeller 1 viewed from the suction port 3. As illustrated in FIG. 4, the suction end 4 of the impeller 1 extends from the rotational center side toward the outer circumference in an opposite direction by angle $\alpha$ relative to the rotational direction of the impeller 1. This way, the fibrous refuse tangled in the suction end is easily forced toward the outer circumference of the suction end.

<Second Embodiment>

Figure 5:
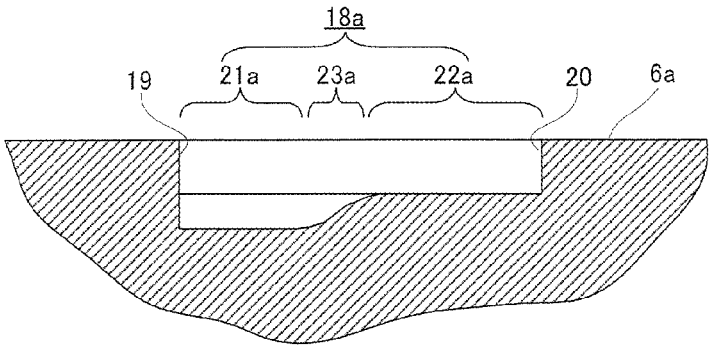
FIG. 5 is a cross-sectional view of a casing liner according to a second embodiment (in which all sections of a groove are connected to one another through curved faces.

FIG. 5 illustrates a casing liner 6*a* according to a second embodiment of the invention. FIG. 5 is an enlarged cross-sectional view of a groove. As illustrated in FIG. 5, a groove 18*a* includes a first section 21*a*, a third section 23*a* and a second section 22*a* arranged in this order widthwise in the same manner as the groove illustrated in FIG. 1C. Although the first to third sections of the groove 18 in FIG. 1C are connected together at the given angle, the first to third sections of the embodiment illustrated in FIG. 5 are connected with a curved face interposed between each of two adjacent sections. This inhibits refuse from accumulating, for example, in a boundary portion between the first section 21*a* and the third section 23*a*.

<Third Embodiment>

Figure 6:
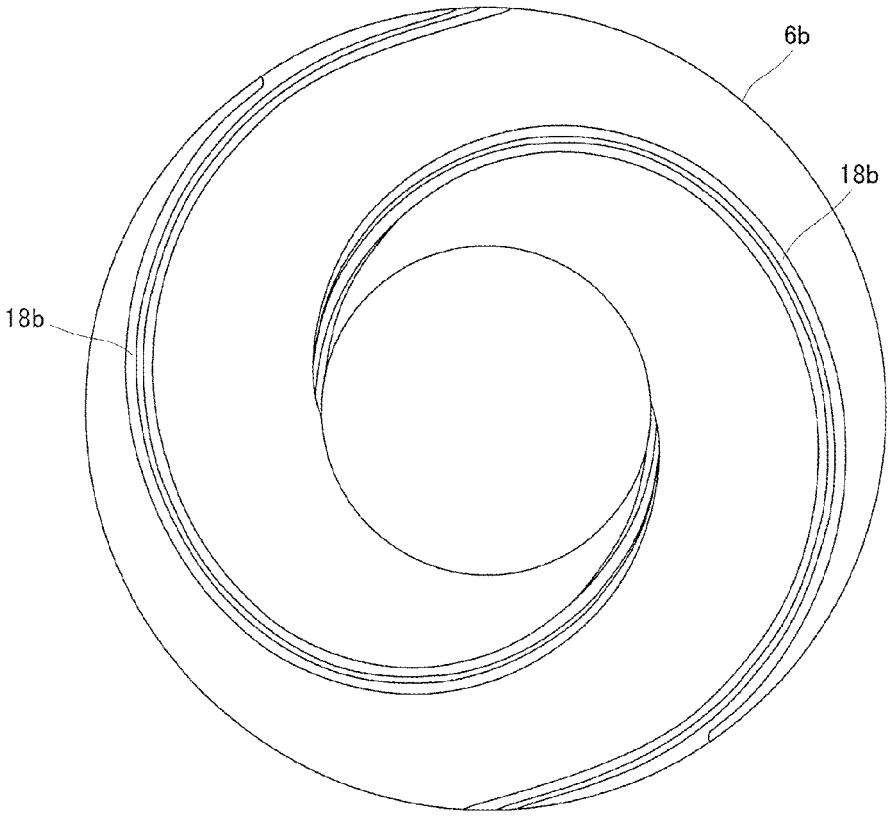
FIG. 6 is a plan view of a casing liner according to a third embodiment (in which two grooves are provided).

A third embodiment illustrated in FIG. 6 differs from the first illustrated in FIG. 1 in that two grooves 18*b* are formed. Forming the two grooves 18*b* instead of one increases the number of intersections between the edge of the blade and the grooves 18*b*. This means that there are more places where fibrous refuse and volumes of large refuse are shredded.

INDUSTRIAL APPLICABILITY

The present invention is applicable to a casing liner for a centrifugal sewage pump.

The present application claims the priority of the Japanese Patent Application No. 2014-112800 filed on May 30, 2014 in Japan. This disclosure is incorporated herein by reference in its entirety.

What is claimed is:

1. A casing liner used for a sewage pump, the casing liner comprising:

a surface to face an edge of a blade of an impeller when the casing liner is assembled with the impeller into the sewage pump, wherein at least one groove with given width is formed in at least a part of the surface, and the groove includes a first section with given depth, which is located on the side close to a rotational center of the impeller, a second section smaller in depth than the first section, which is located on the side far from the rotational center of the impeller, and a third section that is an inclined face connecting the first and second sections, the first to third sections being arranged in a width direction of the groove, wherein an inclination of the bottom surface of the groove changes across a boundary of the first and third sections and across a boundary of the second and third sections.

2. The casing liner according to claim 1, wherein the first and second sections are substantially parallel to an inner wall surface of the casing liner.

3. The casing liner according to claim 1, wherein both ends of the groove are formed into walls substantially perpendicular to the surface of the casing liner.

4. The casing liner according to claim 1, wherein the groove is formed into a spiral extending from a portion corresponding to a suction end of the impeller toward a portion corresponding to an outlet end of the impeller.

5. The casing liner according to claim 1, wherein the groove is formed into a spiral extending in the same direction as a rotational direction of the impeller to approach an outer circumference of the casing liner.

6. The casing liner according to claim 1, wherein the groove is formed within an area where the edge of the blade faces the casing liner when the casing liner is assembled with the impeller into the sewage pump.

7. A sewage pump comprising the casing liner of claim 1, the impeller facing the casing liner, a rotary shaft on which the impeller is mounted, and a motor configured to rotate the rotary shaft.

8. The sewage pump according to claim 7, wherein a suction end of a blade of the impeller extends from the rotational center side radially outward in an opposite direction to the rotational direction of the impeller.

9. The sewage pump according to claim 7, wherein the impeller is of a semi-open type.

10. A casing liner used for a sewage pump, the casing liner comprising:

a surface to face an edge of a blade of an impeller when the casing liner is assembled with the impeller into the sewage pump, wherein at least one groove with given width is formed in at least a part of the surface, and the groove includes a first section with given depth, which is located on the side close to a rotational center of the impeller, a second section smaller in depth than the first section, which is located on the side far from the rotational center of the impeller, and a third section that is an inclined face connecting the first and second sections, the first to third sections being arranged in a width direction of the groove, wherein the first and second sections are substantially parallel to an inner wall surface of the casing liner.

* * * * *